US009782642B1

(12) United States Patent
DeMille et al.

(10) Patent No.: US 9,782,642 B1
(45) **Date of Patent: *Oct. 10, 2017**

(54) GOLF CLUB HEAD WITH ELEVATED INTERNAL WEIGHT

(71) Applicant: Callaway Golf Company, Carlsbad, CA (US)

(72) Inventors: Brandon D. DeMille, Carlsbad, CA (US); Bradley C. Rice, Carlsbad, CA (US); William C. Watson, Temecula, CA (US); Irina Ivanova, San Marcos, CA (US); Joel B. Erickson, Pierce, NE (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/285,712

(22) Filed: Oct. 5, 2016

Related U.S. Application Data

(63) Continuation-in-part of application No. 14/797,512, filed on Jul. 13, 2015, now Pat. No. 9,586,105, which is a continuation-in-part of application No. 14/285,479, filed on May 22, 2014, now Pat. No. 9,211,451, which is a continuation-in-part of application No. 13/797,507, filed on Mar. 12, 2013, now Pat. No. 8,900,070, which is a continuation-in-part of application No. 13/788,173, filed on Mar. 7, 2013, now Pat. No. 8,926,448, which is a continuation-in-part of application No. 13/751,447, filed on (Continued)

(51) Int. Cl.
*A63B 53/04* (2015.01)
*A63B 53/06* (2015.01)

(52) U.S. Cl.
CPC ..... *A63B 53/04* (2013.01); *A63B 53/047* (2013.01); *A63B 53/0466* (2013.01); *A63B 53/0475* (2013.01); *A63B 2053/0408* (2013.01); *A63B 2053/0416* (2013.01); *A63B 2053/0491* (2013.01)

(58) Field of Classification Search
CPC ... A63B 53/04; A63B 53/047; A63B 53/0475; A63B 53/0466; A63B 2053/0416; A63B 2053/0408; A63B 2053/0491; A63B 2053/0433
USPC ..... 473/256, 324–350, 287–292
See application file for complete search history.

(56) References Cited

U.S. PATENT DOCUMENTS 4,065,133 A * 12/1977 Gordos ..... A63B 53/04 473/327
5,213,328 A * 5/1993 Long ..... A63B 53/04 473/346

(Continued)

*Primary Examiner* — Sebastiano Passaniti
(74) *Attorney, Agent, or Firm* — Rebecca Hanovice; Michael Catania; Sonia Lari

(57) ABSTRACT

A golf club head having elevated internal weighting that improves ball speed, reduces backspin, and increases launch angle is disclosed herein. In particular, the golf club head comprises a hollow body with a face, sole, and elevated weight bar, which is disposed inside the body and is fixed to heel and toe sides of the body, preferably with mechanical fasteners such as screws or bolts. The weight bar bridges a central portion of the sole, and a central section of the weight bar, which preferably comprises at least 50% of the overall mass of the weight bar, extends towards the face without actually making contact with the face. The sole also includes at least one slot extending perpendicular to the face and underneath the central section of the weight bar, the slot having a front-to-back length that is greater than a maximum front-to-back length of the weight bar.

20 Claims, 8 Drawing Sheets

Related U.S. Application Data

Jan. 28, 2013, now Pat. No. 8,425,346, which is a continuation of application No. 13/667,692, filed on Nov. 2, 2012, now Pat. No. 8,414,420, which is a continuation of application No. 13/559,279, filed on Jul. 26, 2012, now Pat. No. 8,328,661, which is a continuation of application No. 13/475,497, filed on May 18, 2012, now Pat. No. 8,257,195.

(60) Provisional application No. 61/635,363, filed on Apr. 19, 2012.

(56) References Cited

U.S. PATENT DOCUMENTS 5,257,786 A * 11/1993 Gorman ..... A63B 53/04 473/328
7,582,024 B2 * 9/2009 Shear ..... A63B 53/0466 473/329
7,988,565 B2 * 8/2011 Abe ..... A63B 53/0466 473/328
8,257,195 B1 * 9/2012 Erickson ..... A63B 53/0466 473/329
8,328,661 B1 * 12/2012 Erickson ..... A63B 53/0466 473/329
8,414,420 B1 * 4/2013 Erickson ..... A63B 53/0466 473/329
8,425,346 B1 * 4/2013 Erickson ..... A63B 53/0466 473/329
8,900,070 B1 * 12/2014 Dawson ..... A63B 53/047 473/329
8,926,448 B1 * 1/2015 Ivanova ..... A63B 53/047 473/329
9,211,451 B1 * 12/2015 Westrum ..... A63B 53/047
9,586,105 B1 * 3/2017 Westrum ..... A63B 53/047

* cited by examiner

GOLF CLUB HEAD WITH ELEVATED INTERNAL WEIGHT

CROSS REFERENCES TO RELATED APPLICATIONS

The present application is a continuation-in-part of U.S. patent application Ser. No. 14/797,512, filed on Jul. 13, 2015, which is a continuation-in-part of U.S. patent application Ser. No. 14/285,479, filed on May 22, 2014, and issued on Dec. 15, 2015, as U.S. Pat. No. 9,211,451, which is a continuation-in-part of U.S. patent application Ser. No. 13/797,507, filed on Mar. 12, 2013, and issued on Dec. 2, 2014, as U.S. Pat. No. 8,900,070, which is a continuation-in-part of U.S. patent application Ser. No. 13/788,173, filed on Mar. 7, 2013, and issued on Jan. 6, 2015, as U.S. Pat. No. 8,926,448, which is a continuation-in-part of U.S. patent application Ser. No. 13/751,447, filed on Jan. 28, 2013, and issued on Apr. 23, 2013, as U.S. Pat. No. 8,425,346, which is a continuation of U.S. patent application Ser. No. 13/667,692, filed on Nov. 2, 2012, and issued on Apr. 9, 2013, as U.S. Pat. No. 8,414,420, which is a continuation of U.S. patent application Ser. No. 13/559,279, filed on Jul. 26, 2012, and issued on Dec. 11, 2012, as U.S. Pat. No. 8,328,661, which is a continuation of U.S. patent application Ser. No. 13/475,497, filed on May 18, 2012, and issued on Sep. 4, 2012, as U.S. Pat. No. 8,257,195, which claims priority to U.S. Provisional Patent Application No. 61/635,363, filed on Apr. 19, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having internal weighting that locates the center of gravity of the golf club head close to the face and sole, while bridging at least a portion of the sole.

Description of the Related Art

Golfers often prefer to use golf clubs having low centers of gravity that are also close to the face, which allows for greater control over golf balls during play. There is a need for golf club heads having improved internal weighting that optimizes the mass properties of the golf club head.

BRIEF SUMMARY OF THE INVENTION

One aspect of the present invention is a golf club head, which may be selected from the group consisting of a fairway wood-type head, a driver-type head, a hybrid-type head, and an iron-type head, comprising a body comprising a sole, a hosel, a heel side, a toe side, a face, and a hollow interior, and a weight bar comprising a first end, a second end, a heel support section proximate the first end, a toe support section proximate the second end, and a central section between the heel support section and the toe support section, wherein the face comprises an interior surface facing the hollow interior and an exterior striking surface, wherein the weight bar is disposed within the hollow interior proximate the interior surface of the face, wherein the first end of the weight bar is affixed to the heel side and the second end of the weight bar is affixed to the toe side, wherein the central section of the weight bar bridges at least a central portion of the sole and extends towards the interior surface of the face without making contact with any portion of the face, wherein the sole comprises at least one slot extending approximately perpendicular to the striking surface, and wherein the at least one slot is at least partially disposed beneath the central portion of the weight bar.

In some embodiments, the first end of the weight bar may be connected to the heel side with a first mechanical fastener, and the second end of the weight bar may be connected to the toe side with a second mechanical fastener. In a further embodiment, the heel side may comprise a first through-bore, the toe side may comprise a second through-bore, the first end of the weight bar may comprise a third through-bore, the second end of the weight bar may comprise a fourth through-bore, the first mechanical fastener may extend through the first through-bore and into the third through-bore to affix the first end of the weight bar to the body, and the second mechanical fastener may extend through the second through-bore and into the fourth through-bore to affix the second end of the weight bar to the body.

In other embodiments, the central section of the weight bar may have a first front to back length along a horizontal x-axis extending perpendicular to the face, the at least one slot may have a second front to back length along the horizontal x-axis, and the second length may be greater than the first length. In a further embodiment, the at least one slot may comprise a first slot and a second slot, the first slot may be disposed on a heel side of the sole proximate the hosel and the first end of the weight bar, and the second slot may be disposed on a toe side of the sole proximate the second end of the weight bar. In other embodiments, the weight bar may have a width measured along a horizontal y-axis extending parallel with the face, each of the heel support section and toe support section may comprise no more than 25% of the width, the central section may comprise at least 50% of the width, and the central section may comprise at least 50%, more preferably at least 60%, of the overall mass of the weight bar.

In still other embodiments, the sole may comprise at least one circular opening, and the at least one slot may intersect the at least one circular opening. In a further embodiment, the at least one circular opening may be located at a first end of the at least one slot, which may be located proximate the striking face, or the at least one circular opening may comprise first and second circular openings, the first circular opening may be located at a first end of the at least one slot, and the second circular opening may be located at a second end of the at least one slot. In any of these embodiments, the at least one slot may be at least partially filled with a polymeric material. In any of these embodiments, the body may be composed of a first material having a first density and the weight bar may be composed of a second material having a second density that is greater than the first density. In further embodiments, the golf club head may comprise a composite crown that is sized to cover an upper opening in the body.

Another aspect of the present invention is a wood-type golf club head comprising a body comprising a sole, a hosel, a heel side, a toe side, a rear side, a face portion, a return portion extending away from the face portion towards the rear side, and a hollow interior, a weight bar comprising a first end, a second end, a heel support section proximate the first end, a toe support section proximate the second end, a central section between the heel support section and the toe support section, and an overall mass, a first mechanical fastener, and a second mechanical fastener, wherein the face portion comprises an interior surface facing the hollow interior and an exterior striking surface, wherein the weight bar is disposed within the hollow interior proximate the interior surface of the face, wherein the first end of the weight bar is connected to the heel side with the first mechanical fastener and the second end of the weight bar is connected to the toe side with the second mechanical fastener, wherein the central section bridges at least a central portion of the sole and extends towards the interior surface of the face without making contact with any portion of the face, wherein the central section comprises at least 50% of the overall mass, wherein the sole comprises first and second slots extending approximately perpendicular to the face portion, wherein each of the first and second slots is at least partially disposed beneath the central portion of the weight bar, wherein the body is composed of a first material having a first density, wherein the weight bar is composed of a second material having a second density, and wherein the first density is lower than the second density.

In a further embodiment, the golf club head may further comprise a crown, the sole and the return portion may define an upper opening in the body, which may be encircled by a bond flange, the crown may be permanently affixed to the bond flange with an adhesive material to close the upper opening, and the crown may be composed of a material having a third density that is lower than the first density. In another embodiment, the central section may comprise more than 60% of the overall mass. In still another embodiment, the weight bar may have a width measured along a horizontal y-axis extending parallel with the face portion, each of the heel support section and toe support section may comprise no more than 25% of the width, and the central section may comprise at least 50% of the width. In yet another embodiment, the central section of the weight bar may have a first front-to-rear length designated as L1, the heel support section may have a second front-to-rear length designated as L2, the toe support section may have a third front-to-rear length designated as L3, and L1≥2×L2 and L1≥2×L3.

Yet another aspect of the present invention is a fairway wood golf club head comprising a cast metal alloy body comprising a sole, a hosel, a heel side, a toe side, a rear side, a face, an upper opening, and a hollow interior, a weight bar comprising a first end, a second end, a heel support section proximate the first end, a toe support section proximate the second end, a central section between the heel support section and the toe support section, an overall mass, and an overall width measured along a horizontal y-axis extending parallel with the face, and a carbon composite crown sized to close the upper opening, wherein the sole comprises first and second slots in communication with the hollow interior and extending approximately perpendicular to the face, wherein the weight bar is disposed within the hollow interior proximate the face, wherein the first end of the weight bar is connected to the heel side and the second end of the weight bar is connected to the toe side, wherein the central section bridges at least a central portion of the sole, extends towards the face without making contact with any portion of the face, has a first front-to-rear length designated as L1, comprises at least 50% of the overall width of the weight bar, and comprises at least 60% of the overall mass of the weight bar, wherein the heel support section has a second front-to-rear length designated as L2, wherein the toe support section has a third front-to-rear length designated as L3, wherein at least one of the first and second slots has a fourth front-to-rear length designated as L4, wherein L1≥2×L2 and L1≥2×L3, and wherein L4≥L1.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
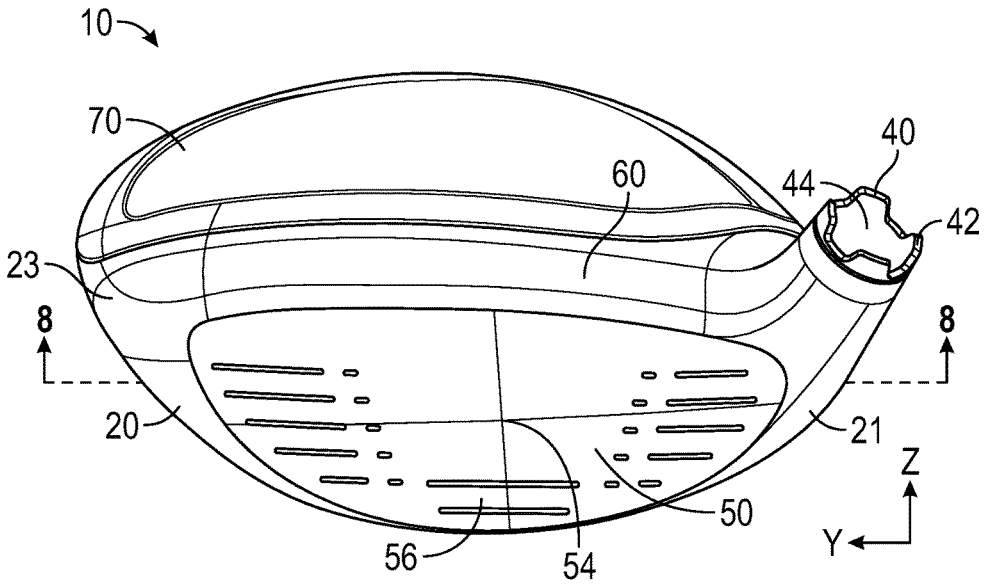
FIG. 1 is a front perspective view of a first embodiment of the present invention.
Figure 2:
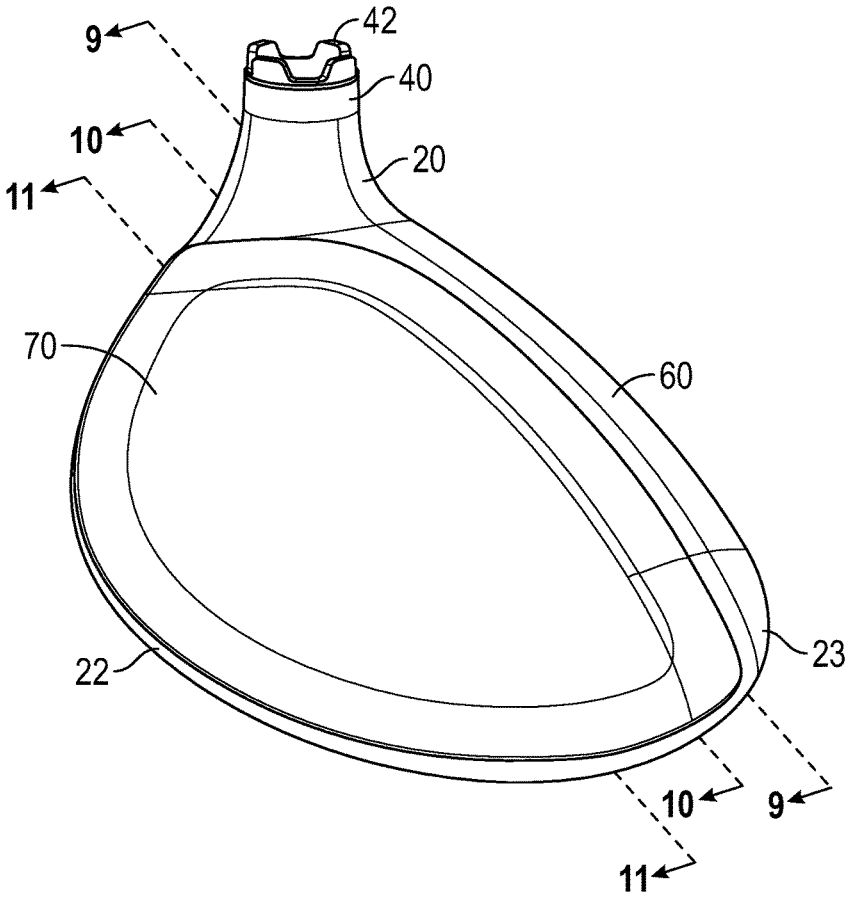
FIG. 2 is rear perspective view of the embodiment shown in FIG. 1.
Figure 3:
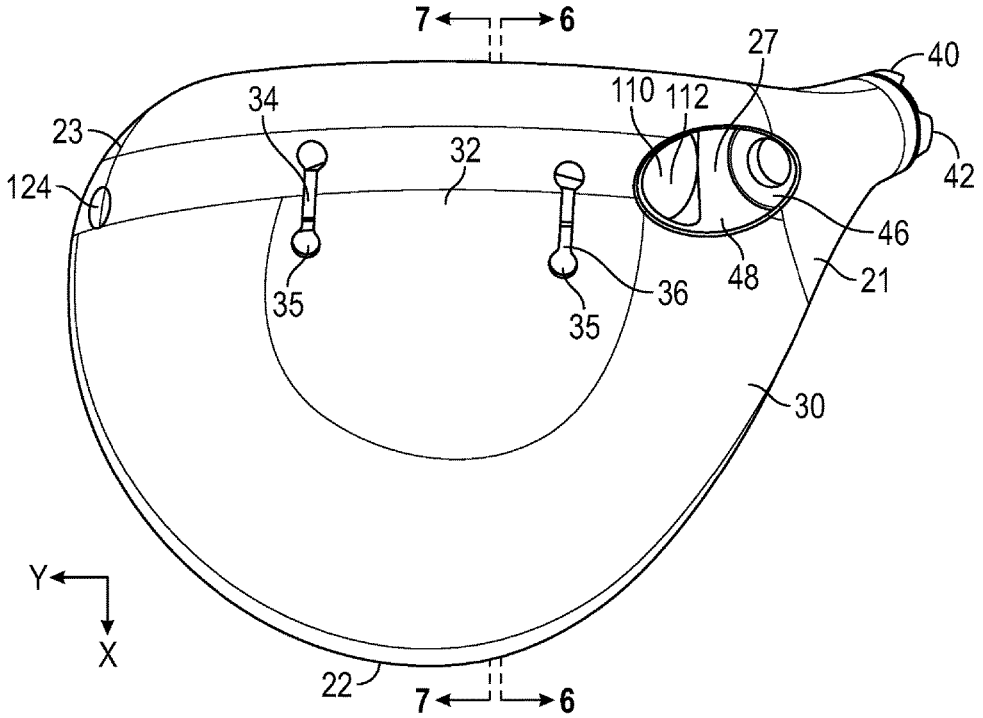
FIG. 3 is a sole elevational view of the embodiment shown in FIG. 1 without the crown.
Figure 4:
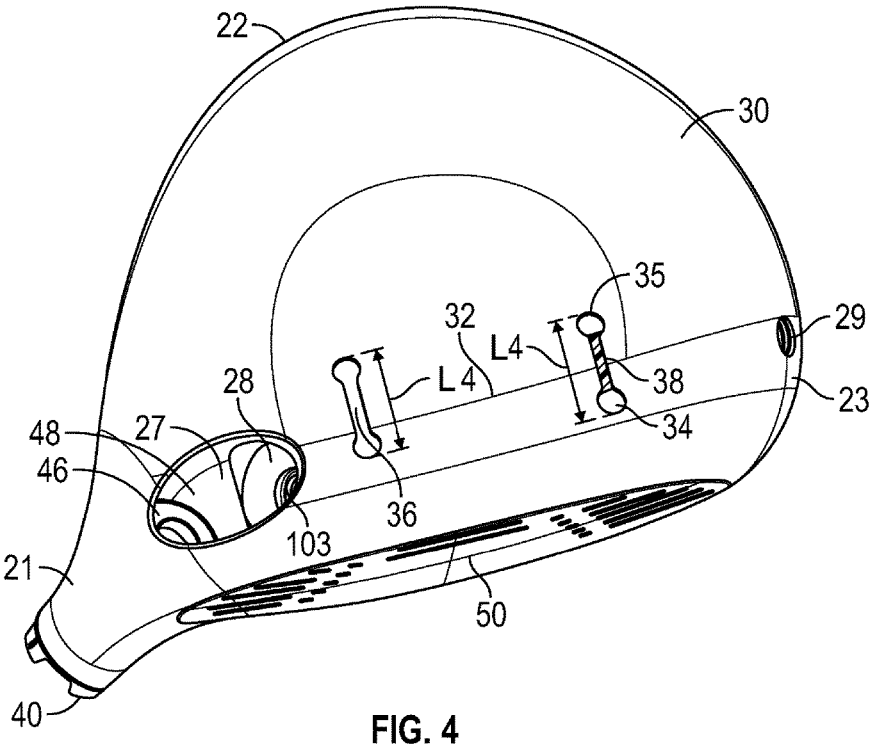
FIG. 4 is a sole elevational view of the embodiment shown in FIG. 3 without the mechanical fasteners.
Figure 5:
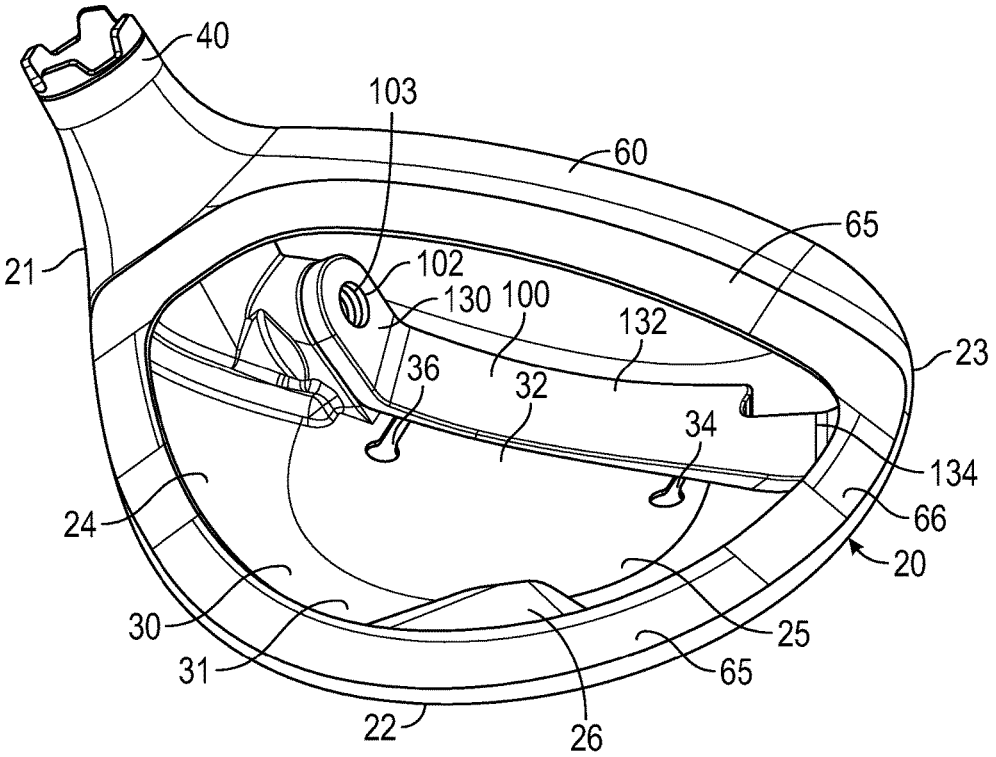
FIG. 5 is a top perspective view of the embodiment shown in FIG. 4.
Figure 6:
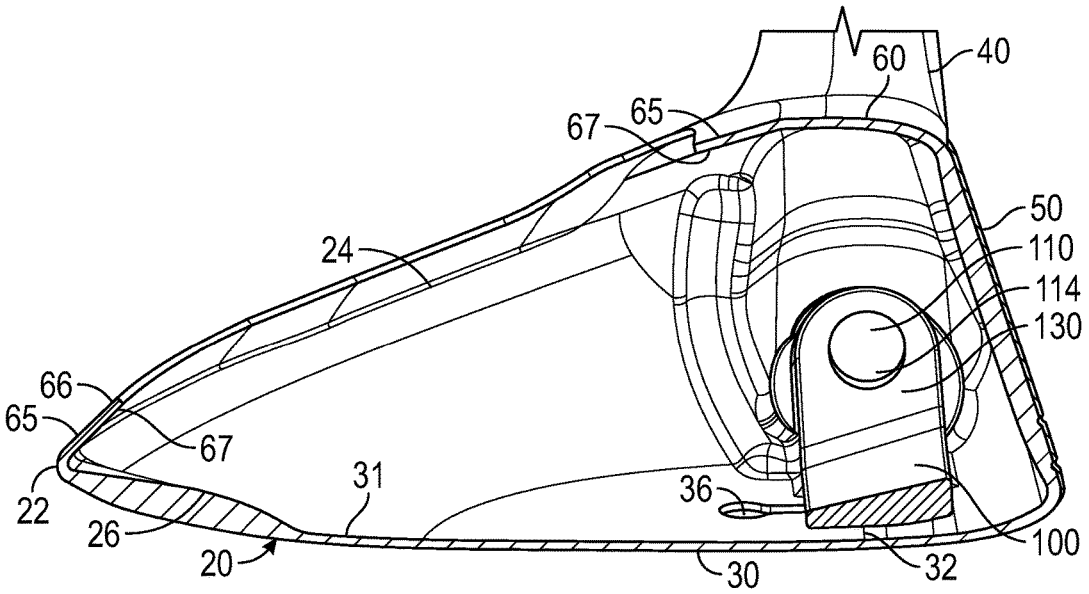
FIG. 6 is a cross-sectional view of the embodiment shown in FIG. 3 along lines 6-6.
Figure 7:
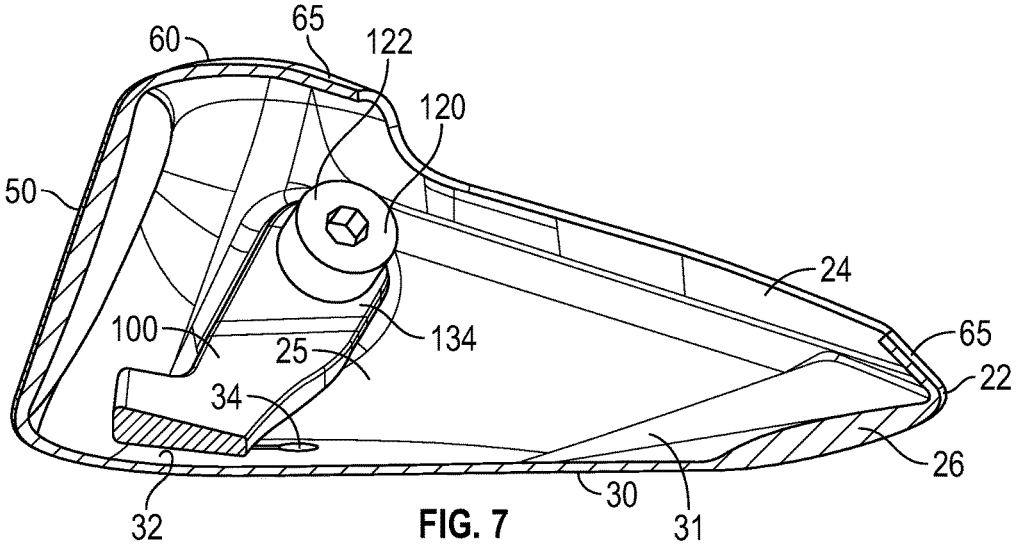
FIG. 7 is a cross-sectional view of the embodiment shown in FIG. 3 along lines 7-7.
Figure 8:
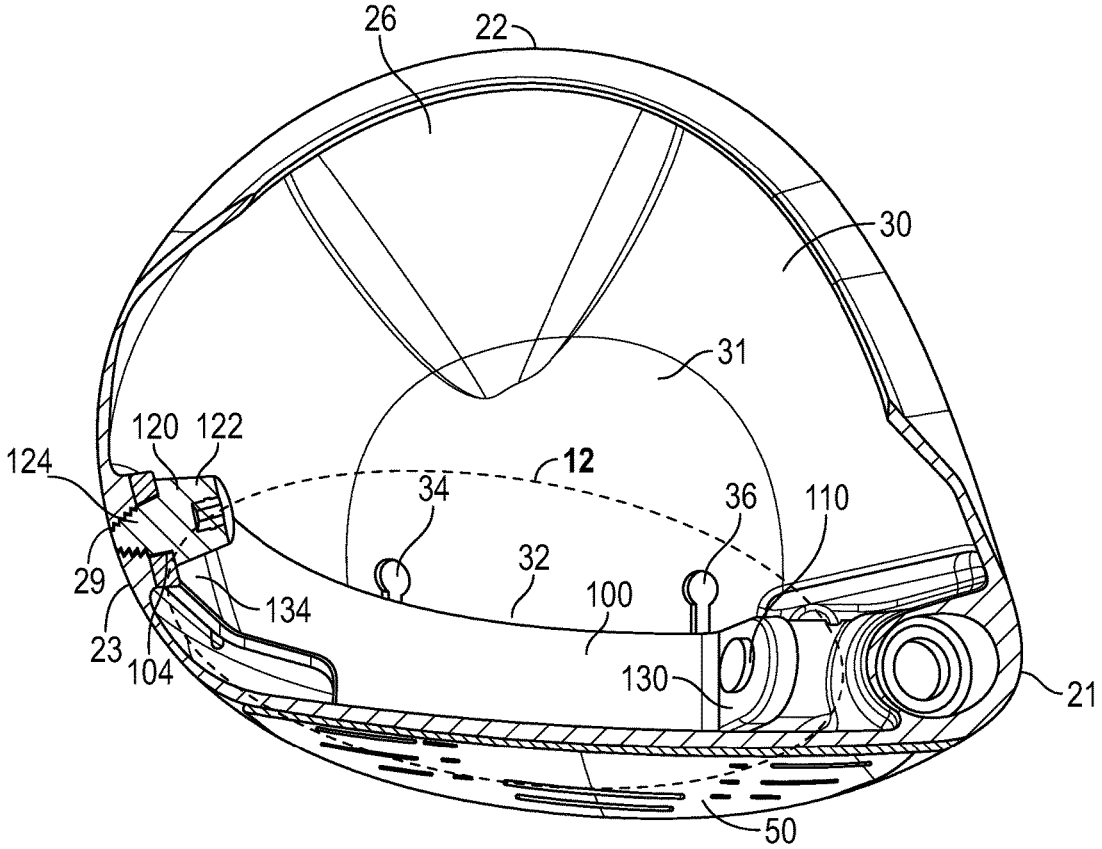
FIG. 8 is a cross-sectional view of the embodiment shown in FIG. 1 along lines 8-8.
Figure 9:
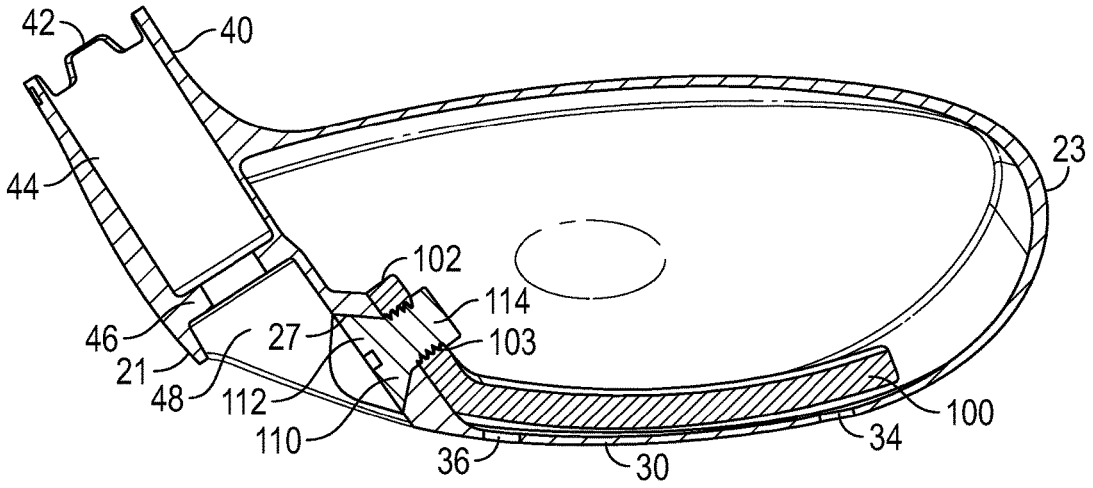
FIG. 9 is a cross-sectional view of the embodiment shown in FIG. 2 along lines 9-9.
Figure 10:
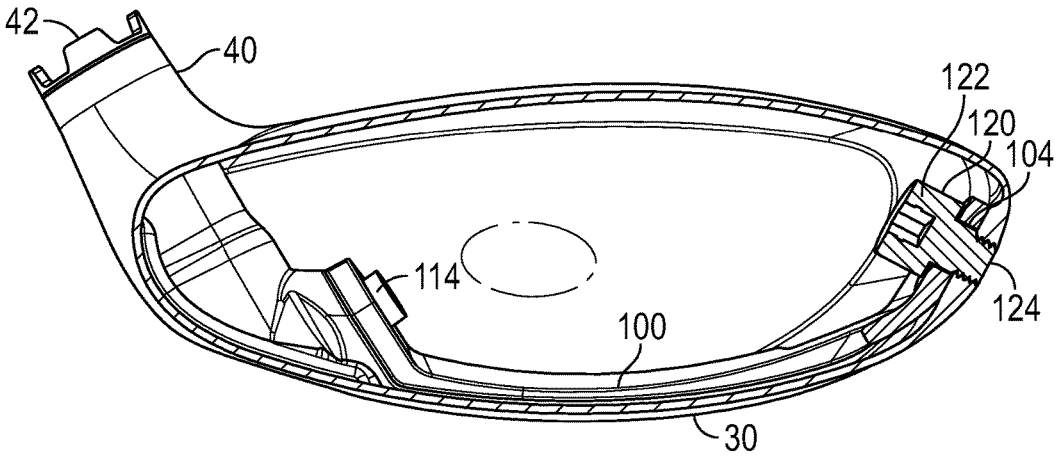
FIG. 10 is a cross-sectional view of the embodiment shown in FIG. 2 along lines 10-10.
Figure 11:
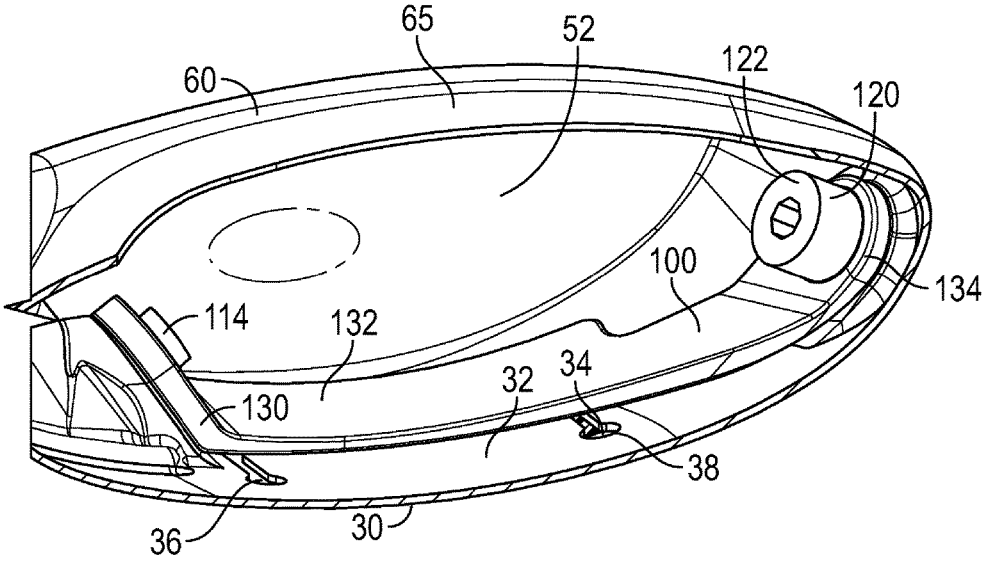
FIG 11. is a cross-sectional view of the embodiment shown in FIG. 2 along lines 11-11.
Figure 12:
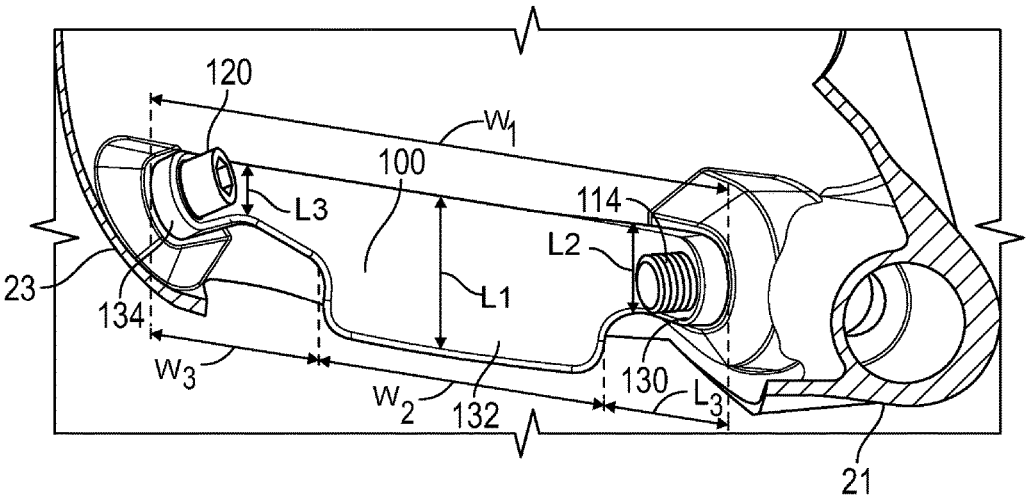
FIG. 12 is an enlarged view of the circled portion of the embodiment shown in FIG. 8.

The present invention is generally directed to a golf club head having internal weighting that places the golf club center of gravity (CG) at a point near both the face and the sole of the golf club head. In particular, the present invention is directed to elevated internal weighting bridging at least a central area of the sole in smaller golf club heads, particularly small drivers, fairway woods, hybrids, and utility clubs.

A preferred embodiment of the present invention is shown in FIGS. 1-12. The golf club head 10, which in the preferred embodiment is a fairway wood or small driver head, includes a body 20 having a sole 30, a hosel 40 located at a heel side 21, a rear side 22, a toe side 23, a striking face 50 opposite the rear side 22, a return portion 60 extending away from the striking face 50 towards the rear side 22 of the body 20, a weight pad 26 extending from an interior surface 31 of the sole 30 proximate the rear side 22, and a hollow interior 25 delineated by these elements. The hosel 40 preferably includes alignment features 42 to receive an adjustable shaft sleeve assembly (not shown), a shaft-receiving bore 44, an internal flange 46, and an outlet 48 proximate the sole 30 where a fastener (not shown) can be inserted to engage the adjustable shaft sleeve assembly. The sole 30 and return portion 60 define an upper opening 24 in the body 20, which is encircled by a bond flange 65 extending inwards from the return portion 60 and the sole 30. The body 20 preferably is composed of a metal alloy material, and more preferably is integrally cast from a material such as titanium alloy or steel, though in one alternative embodiment the hosel 40 is formed separately from a lightweight material with a density of less than 3.5 g/cc, such as carbon composite or plastic, to move the center of gravity of the golf club head 10 towards the toe side 23. The upper opening 24 is closed by a crown 70, which preferably is composed of a lightweight material such as carbon composite or plastic, and which is fixed to the outer or inner surfaces 66, 67, but preferably the outer surface 66, of the bond flange 65 with a permanent adhesive material.

As shown in FIGS. 5-12, the golf club head 10 also includes an elevated weight bar 100, which is affixed within the hollow interior 25 of the body 20 only at a heel side 21 and toe side 23 of the golf club head 10, effectively bridging a central portion 32 of the sole 30 proximate the striking face 50. This structure allows for activation of the striking face 50 and the sole 30 without having an excessive effect on mass properties, as the weight bar 100 acts as a torsion spring during impact of the golf club head 10 with a ball. The weight bar 100 preferably is manufactured separately from the body 20 and is mechanically attached to the body 20 after manufacture, as shown in the Figures, though in alternative embodiments the weight bar 100 may be affixed within the body via epoxy, welding, brazing, or may be integrally cast, molded, machined, or otherwise manufactured with the body 20.

As shown in FIGS. 6-12, the weight bar 100 comprises a heel-side through-bore 102 and a toe-side through-bore 104 sized to receive heel- and toe-side mechanical fasteners 110, 120, each having a head portion 112, 122 and a threaded extension portion 114, 124. The heel-side through-bore 102 preferably comprises internal threading 103, while the toe-side through-bore 104 preferably has a smooth internal surface 105. The threaded extension portion 114 of the heel-side mechanical fastener 110 extends through an unthreaded through-bore 28 in the heel side 21 of the body 20 to engage the internal threading 103 of the heel-side through-bore 102, such that the head portion 112 abuts an exterior surface 27 of the body 20, preferably within the outlet 48 of the hosel 40 so that the head portion 112 doesn't connect with turf or otherwise interfere with play. In contrast, the threaded extension portion 124 of the toe-side mechanical fastener 120 extends through the toe-side through-bore 104 of the weight bar 100 to engage a threaded through-bore 29 in the toe side 23 of the body, such that the head portion 122 abuts the weight bar 100 and is disposed entirely within the hollow interior 25. The heel- and toe-side mechanical fasteners 110, 120 may be made of multiple materials, and the densities of each of these mechanical fasteners 110, 120 can be selected to increase or minimize mass at the heel side 21 and toe side 23 of the golf club head 10.

The weight bar 100 preferably includes a heel support section 130 where the heel-side through-bore 102 is located, a central section 132, and a toe support section 134 where the toe-side through-bore 104 is located. The central section 132 preferably has a heel-to-toe width ($W_2$) along a horizontal y axis that is at least one third of the overall heel-to-toe width of the weight bar 100 ($W_1$), and preferably at least 50% of the overall width, while each of the heel and toe support sections 130, 134 preferably has a heel-to-toe width ($W_3$) that is no greater than one third of $W_1$, preferably no more than 25% of the width. As shown in the Figures, the central section 132 has a maximum front to rear length ($L_1$) along a horizontal x axis that is at least twice that of the maximum front to rear length of the heel support section 130 ($L_2$) or the toe support section 134 ($L_3$), such that at least 50%, and preferably more than 60%, of the overall mass of the weight bar 100 is located at the central section 132. This central section 132 extends towards the rear surface 52 of the striking face 50 without actually making contact with any part of it, and is the part of the weight bar 100 that is closest to the striking face 50. While the weight bar 100 preferably is composed of a single material for the sake of manufacturing simplicity, it may be composed of multiple materials to further enhance its effects on the mass properties of the golf club head 10. In one alternative embodiment, the central section 132 is composed of a high density metal alloy such as tungsten alloy, while the heel and toe support sections 130, 134 are composed of titanium alloy, steel, and/or aluminum alloy.

The inertia of the weight bar 100 during impact of the golf club head 10 with a ball improves sole 30 compliance by enhancing the bending capabilities of thinner regions of the sole 30. The weight construction shown in these Figures also allows the manufacturer of the golf club head 10 to take weight away from, and thus thin out, the sole 30, which allows the sole 30 to flex and bend more easily, reduces sole 30 stiffness, and thus contributes more to performance of the striking face 50. The performance of the golf club head 10 is further enhanced through the inclusion of a pair of slots 34, 36 in the sole extending underneath the weight bar 100 approximately perpendicular to the striking face 50 without contacting any portion of the striking face 50. The face-most ends of each slot 34, 36 are located close to the face, preferably no more than 0.75 inch, and more preferably no more than 0.50 inch. Each slot 34, 36 preferably has a length ($L_4$) that is greater than that of the length of any portion of the weight bar 100, rounded, circular ends 35, and provides a direct opening into (and communicates with) the hollow interior 25 of the golf club head 10, though the slots 34, 36 may be partially or completely filled with an elastic polymer 38 to prevent debris from entering the golf club head 10.

Figure 13:
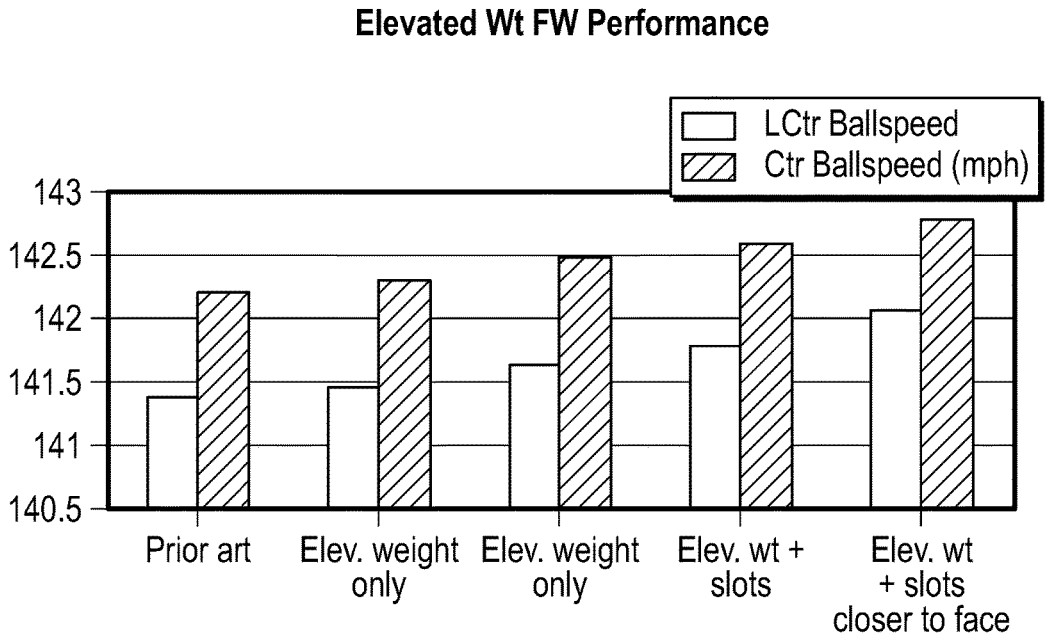
FIG. 13 is a graph comparing the speed of golf balls hit by prototypes of the embodiment shown in FIG. 1 with the speed of golf balls hit by prior art club heads.
Figure 14:
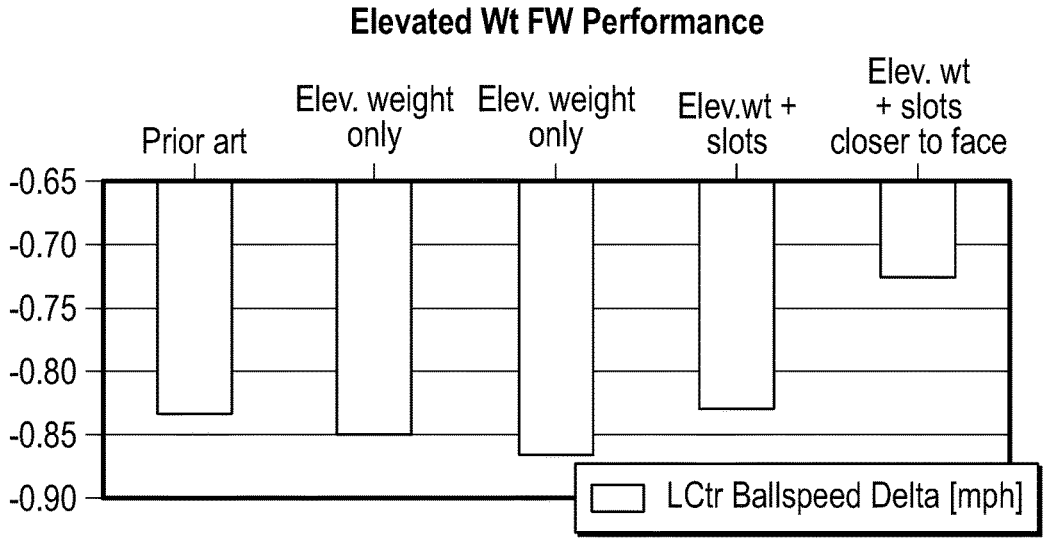
FIG. 14 is a graph comparing the change in the speed of golf balls hit by prototypes of the embodiment shown in FIG. 1 with the change in speed of golf balls hit by prior art club heads.
Figure 15:
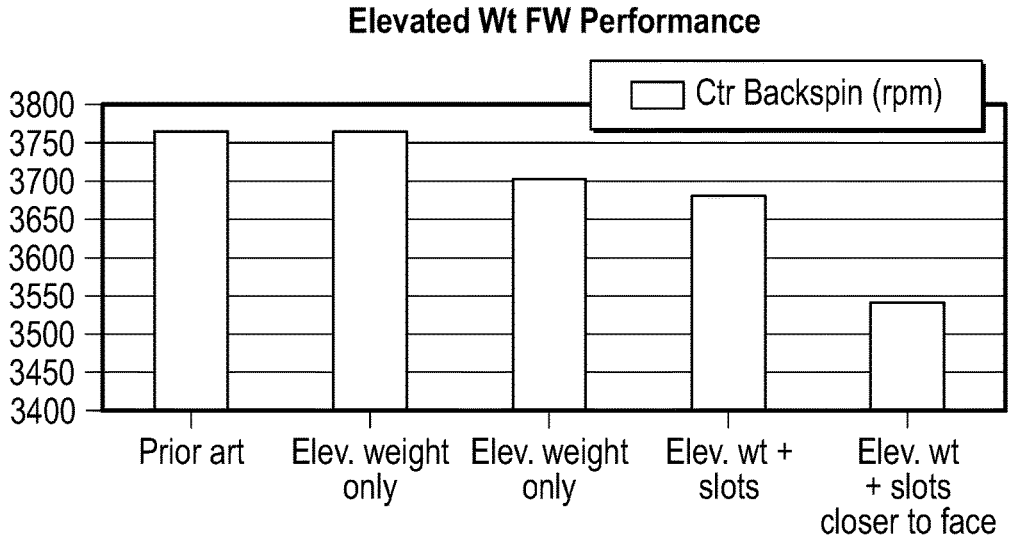
FIG. 15 is a graph comparing the backspin of golf balls hit by prototypes of the embodiment shown in FIG. 1 with the change in speed of golf balls hit by prior art club heads.
Figure 16:
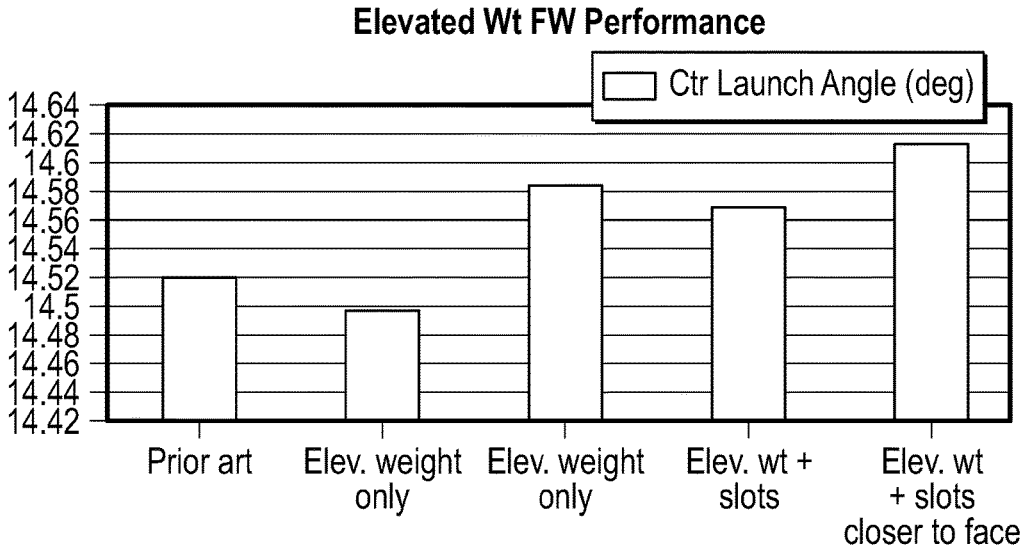
FIG. 16 is a graph comparing the launch angle of golf balls hit by prototypes of the embodiment shown in FIG. 1 with the launch angle of golf balls hit by prior art club heads.

As shown in FIGS. 13-16, while the weight bar itself 100 improves ball speed, reduces backspin, and increases launch angle of golf balls impacted by clubs including this feature, the combination of the weight bar 100 with the slots 34, 36 greatly improves all of these characteristics. For example, as shown in FIGS. 13 and 14, the weight bar 100 and slots 34, 36 improve the speed of golf balls impacted by the center 54 and low center 56 of the striking face 50, with a greater increase in low center 56 ball speed. The weight bar 100 and slots 34, 36 also reduce backspin of a golf ball off the striking face 50, particularly when the slots 34, 36 have ends that are close to the striking face 50, with a slight increase in launch angle, thus translating to greater ball distance.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a sole, a hosel, a heel side, a toe side, a face, and a hollow interior; and a weight bar comprising a first end, a second end, a heel support section proximate the first end, a toe support section proximate the second end, and a central section between the heel support section and the toe support section, wherein the face comprises an interior surface facing the hollow interior and an exterior striking surface, wherein the weight bar is disposed within the hollow interior proximate the interior surface of the face, wherein the first end of the weight bar is affixed to the heel side and the second end of the weight bar is affixed to the toe side, wherein the central section of the weight bar bridges at least a central portion of the sole and extends towards the interior surface of the face without making contact with any portion of the face, wherein the sole comprises at least one slot extending approximately perpendicular to the striking surface, and wherein the at least one slot is at least partially disposed beneath the central portion of the weight bar.

2. The golf club head of claim 1, wherein the first end of the weight bar is connected to the heel side with a first mechanical fastener, and wherein the second end of the weight bar is connected to the toe side with a second mechanical fastener.

3. The golf club head of claim 2, wherein the heel side comprises a first through-bore, wherein the toe side comprises a second through-bore, wherein the first end of the weight bar comprises a third through-bore, wherein the second end of the weight bar comprises a fourth through-bore, wherein the first mechanical fastener extends through the first through-bore and into the third through-bore to affix the first end of the weight bar to the body, and wherein the second mechanical fastener extends through the second through-bore and into the fourth through-bore to affix the second end of the weight bar to the body.

4. The golf club head of claim 1, wherein the central section of the weight bar has a first front-to-back length along a horizontal x-axis extending perpendicular to the face, wherein the at least one slot has a second front-to-back length along the horizontal x-axis, and wherein the second width is greater than the first width.

5. The golf club head of claim 4, wherein the at least one slot comprises a first slot and a second slot, wherein the first slot is disposed on a heel side of the sole proximate the hosel and the first end of the weight bar, and wherein the second slot is disposed on a toe side of the sole proximate the second end of the weight bar.

6. The golf club head of claim 1, wherein the weight bar has a width measured along a horizontal y-axis extending parallel with the face, wherein each of the heel support section and toe support section comprises no more than 25% of the width, wherein the central section comprises at least 50% of the width, wherein the weight bar has a mass, and wherein the central section comprises at least 50% of the mass of the weight bar.

7. The golf club head of claim 6, wherein the central section comprises at least 60% of the mass of the weight bar.

8. The golf club head of claim 1, wherein the sole comprises at least one circular opening, and wherein the at least one slot intersects the at least one circular opening.

9. The golf club head of claim 8, wherein the at least one circular opening is located at a first end of the at least one slot, and wherein the first end of the slot is located proximate the striking face.

10. The golf club head of claim 8, wherein the at least one circular opening comprises first and second circular openings, wherein the first circular opening is located at a first end of the at least one slot, and wherein the second circular opening is located at a second end of the at least one slot.

11. The golf club head of claim 1, wherein the at least one slot is at least partially filled with a polymeric material.

12. The golf club head of claim 1, wherein the golf club head is selected from the group consisting of a fairway wood-type head, a driver-type head, a hybrid-type head, and an iron-type head.

13. The golf club head of claim 1, wherein the body is composed of a first material having a first density, wherein the weight bar is composed of a second material having a second density, and wherein the first density is lower than the second density.

14. The golf club head of claim 13, further comprising a composite crown, wherein the body comprises an upper opening, and wherein the composite crown is sized to cover the upper opening.

15. A wood-type golf club head comprising:

a body comprising a sole, a hosel, a heel side, a toe side, a rear side, a face portion, a return portion extending away from the face portion towards the rear side, and a hollow interior;

a weight bar comprising a first end, a second end, a heel support section proximate the first end, a toe support section proximate the second end, a central section between the heel support section and the toe support section, and an overall mass;

a first mechanical fastener, and a second mechanical fastener, wherein the face portion comprises an interior surface facing the hollow interior and an exterior striking surface, wherein the weight bar is disposed within the hollow interior proximate the interior surface of the face, wherein the first end of the weight bar is connected to the heel side with the first mechanical fastener and the second end of the weight bar is connected to the toe side with the second mechanical fastener, wherein the central section bridges at least a central portion of the sole and extends towards the interior surface of the face without making contact with any portion of the face, wherein the central section comprises at least 50% of the overall mass, wherein the sole comprises first and second slots extending approximately perpendicular to the face portion, wherein each of the first and second slots is at least partially disposed beneath the central portion of the weight bar, wherein the body is composed of a first material having a first density, wherein the weight bar is composed of a second material having a second density, and wherein the first density is lower than the second density.

16. The wood-type golf club head of claim 15, further comprising a crown, wherein the sole and the return portion define an upper opening in the body, wherein the upper opening is encircled by a bond flange, wherein the crown is permanently affixed to the bond flange with an adhesive material to close the upper opening, wherein the crown is composed of a material having a third density, and wherein the third density is lower than the first density.

17. The wood-type golf club head of claim 15, wherein the central section comprises more than 60% of the overall mass.

18. The wood-type golf club head of claim 17, wherein the weight bar has a width measured along a horizontal y-axis extending parallel with the face portion, wherein each of the heel support section and toe support section comprises no more than 25% of the width, wherein the central section comprises at least 50% of the width.

19. The wood-type golf club head of claim 17, wherein the central section of the weight bar has a first front-to-rear length designated as L1, wherein the heel support section has a second front-to-rear length designated as L2, wherein the toe support section has a third front-to-rear length designated as L3, and wherein L1≥2×L2 and L1≥2×L3.

20. A fairway wood golf club head comprising:

a cast metal alloy body comprising a sole, a hosel, a heel side, a toe side, a rear side, a face, an upper opening, and a hollow interior;

a weight bar comprising a first end, a second end, a heel support section proximate the first end, a toe support section proximate the second end, a central section between the heel support section and the toe support section, an overall mass, and an overall width measured along a horizontal y-axis extending parallel with the face; and a carbon composite crown sized to close the upper opening, wherein the sole comprises first and second slots in communication with the hollow interior and extending approximately perpendicular to the face, wherein the weight bar is disposed within the hollow interior proximate the face, wherein the first end of the weight bar is connected to the heel side and the second end of the weight bar is connected to the toe side, wherein the central section bridges at least a central portion of the sole, extends towards the face without making contact with any portion of the face, has a first front-to-rear length designated as L1, comprises at least 50% of the overall width of the weight bar, and comprises at least 60% of the overall mass of the weight bar, wherein the heel support section has a second front-to-rear length designated as L2, wherein the toe support section has a third front-to-rear length designated as L3, wherein at least one of the first and second slots has a fourth front-to-rear length designated as L4, wherein L1≥2×L2, wherein L1≥2×L3, and wherein L4≥L1.

* * * * *